US005819810A

United States Patent [19]

Kramer et al.

[11] Patent Number: 5,819,810

[45] Date of Patent: Oct. 13, 1998

[54] HEDDLE FRAME ASSEMBLY WITH CORNER SLEEVE MEMBER

[75] Inventors: Charles F. Kramer, Greenville; Michael T. King, Williamston; Gene E. Faasse, Taylors, all of S.C.

[73] Assignee: Steel Heddle Manufacturing Company, Greenville, S.C.

[21] Appl. No.: 840,871

[22] Filed: Apr. 17, 1997

[51] Int. Cl.[6] ..... D03C 9/06

[52] U.S. Cl. ..... 139/91; 139/92; 403/231

[58] Field of Search ..... 139/91, 92; 403/231

[56] References Cited

U.S. PATENT DOCUMENTS

| | | | |
|---|---|---|---|
| 4,015,638 | 4/1977 | Graf | 139/91 |
| 4,355,667 | 10/1982 | Shimizu | 139/91 |
| 4,741,367 | 5/1988 | Kitawaki | 139/91 |
| 5,297,589 | 3/1994 | Baumann | 139/91 |
| 5,351,719 | 10/1994 | Graf | 139/91 |
| 5,411,061 | 5/1995 | Faase | 139/91 |
| 5,477,889 | 12/1995 | Faase et al. | 139/91 |

*Primary Examiner*—Andy Falik
*Attorney, Agent, or Firm*—Dority & Manning

[57] ABSTRACT

A heddle frame has a pair of laterally extending slats and a pair of end braces connected to the slats to form a generally rectangular frame. An elongated opening is defined at least in the ends of the slats, and typically throughout the slat. A locking mechanism is configured to lock the end braces to the slats and typically includes a device housed at least in part within the slats. A corner sleeve member is adhesively fixed on the slats at the ends thereof directly adjacent to the end braces to structurally reinforce the slats at the position of the locking mechanism.

20 Claims, 3 Drawing Sheets

HEDDLE FRAME ASSEMBLY WITH CORNER SLEEVE MEMBER

BACKGROUND OF THE INVENTION

In order to make heddle frames more lightweight and therefore to decrease the power required to drive the heddle frames vertically during shedding operations, the industry has turned towards the use of lightweight aluminum or composite rails or slats. The slats are connected to end braces to form a generally rectangular heddle frame. The heddles are hung on heddle rods fixed along the length of the slats.

However, ever increasing dynamic forces resulting from higher weaving speeds are contributing to failure and weakening of the frames generally near the ends of the slats. In particular, a critical area exists where the slat is mechanically attached to the end brace. This critical area typically includes a mechanical locking device that fits or slides into the hollow space defined by the profile of the slat.

Thus, what is needed in the art is a device to reinforce the slats and therefore increase the service life of the heddle frames without substantially adding to the weight or complexity of the heddle frame components.

OBJECTS AND SUMMARY OF THE INVENTION

It is therefore a principle object of the present invention to provide a reinforced heddle frame which substantially decreases weakening or failure of the frames at the critical corner junctions.

It is another object of the present invention to provide an improved lightweight slat assembly for use in heddle frames.

And yet another object of the present invention is to provide an improved heddle frame for use on any conventional weaving machine.

Additional objects and advantages of the invention will be set forth in part in the following description, or may be obvious from the description, or may be learned through practice of the invention.

In accordance with the objects and purposes of the invention, a heddle frame is provided which includes a pair of laterally extending slats and a pair of end braces connected to the slats to form a generally rectangular frame. An elongated opening is defined in the end of the slats. Typically, the slats are of an extruded aluminum or carbon fiber composite.

A conventional locking mechanism is configured with the end braces and the slats to connect the elements together. The locking mechanism is typically disposed at least partially within the elongated opening.

A corner reinforcing sleeve member is attached, for example by an adhesive or screws to the slats at the ends thereof directly adjacent to the end braces. The corner sleeve member structurally reinforces the slats at the position of the locking mechanism. Preferably, the corner sleeve member may comprise an essentially U-shaped member that fits over the outward edge of the slats. The sleeve member may be removably attached. The locking member typically includes at least one bolt member disposed through the outward edge of the slats. In this regard, the U-shaped member should include at least one hole therethrough to accommodate the bolt.

The U-shaped corner sleeve member may be formed of a single integral piece, or may be comprised of two separate pieces. For instance, the two pieces may overlap or butt together on the outward edge of the slat and be held relative to the slat by the locking mechanism bolts and/or an adhesive.

The corner sleeve member comprises side segments which extend alongside the flat sections of the slats. The side segments may be of the same length and extend generally to the heddle rod. In an alternative embodiment, the side segments are of unequal length with the longer side segment being disposed on the slat opposite the side containing the heddle rod.

Preferably, the U-shaped corner sleeve member is adhesively attached to the slat. In an alternative embodiment, the sleeve member may be removably fitted on the slat so that the sleeve can be easily replaced and also retrofitted to existing frames.

DETAILED DESCRIPTION OF THE PREFERRED EMBODIMENTS

Figure 1:
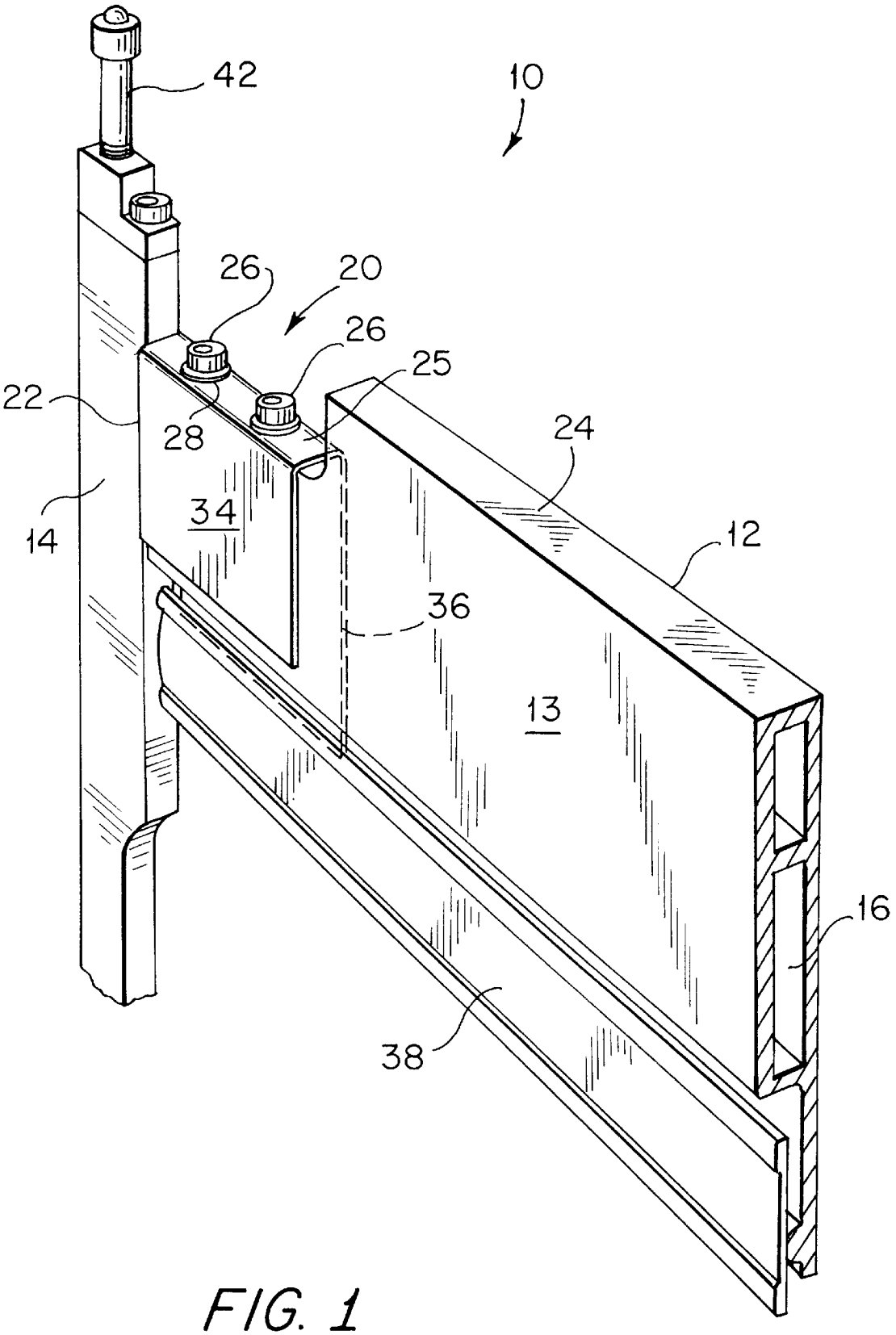
FIG. 1 is a view of a corner connection of a heddle frame particularly illustrating the heddle slat and end brace assembly.

Reference will now be made in detail to the presently preferred embodiments of the invention. One or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the appended claims and their equivalents. The numbering of components in the drawings is consistent throughout the application, with the same components having the same number in each of the drawings.

Figure 2:
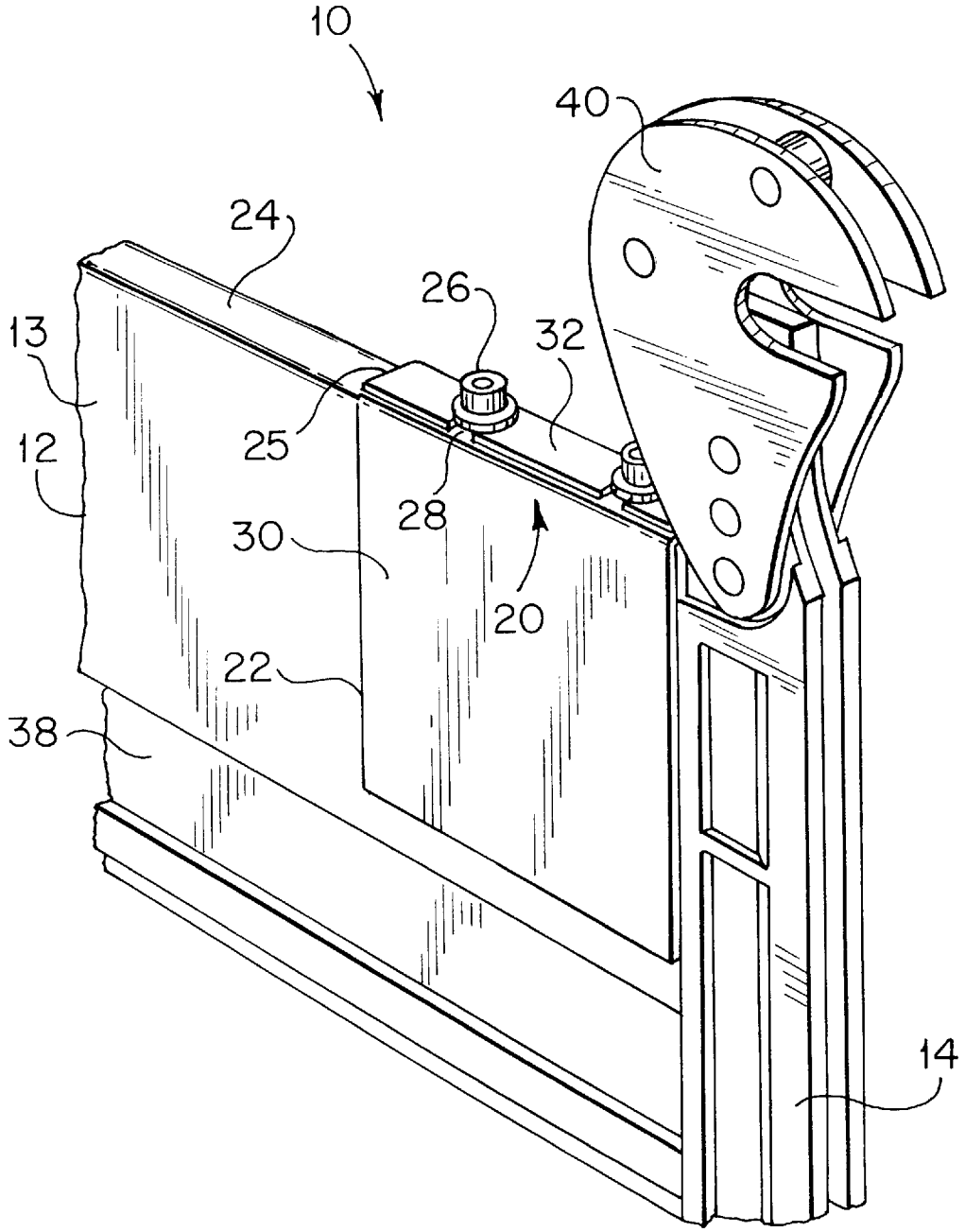
FIG. 2 is an alternative view of a heddle slat and end brace assembly.

The invention relates to an improved heddle frame, partially illustrated as element 10 in FIGS. 1 and 2. The general construction of conventional heddle frames is well understood by those skilled in the art and a detailed explanation is not necessary for purposes of the present disclosure. In general though, heddle frames 10 include horizontal slats connected to end braces 14. Slats 12 are typically of a lightweight aluminum profile or composite material, as generally illustrated in FIG. 1. This type of heddle frame is widely used in the art and preferred for its light weight and strength.

The invention is not limited to any particular configuration or commercial type of heddle frame. For example, FIG. 1 illustrates a well known heddle frame wherein a drive bolt 42 extends through end brace 14. This type of device is illustrated particularly in U.S. Pat. No. 5,477,889, which is incorporated herein by reference. Likewise, FIG. 2 illustrates an alternative type of heddle frame wherein a drive element 40 is connected to end brace 14. This type of device is also described in the '889 patent.

A locking mechanism, generally 20, is provided to mechanically lock slats 12 to end braces 14, as is commonly understood. With the extruded aluminum profile slats 12 illustrated in the figures, an opening 16 is generally defined in the slats. The locking mechanism 20 includes components which may be housed at least partially within opening 16. Suitable locking mechanisms are described in detail in U.S. Pat. No. 5,477,889 which is incorporated herein by reference. However, it should be understood, that any manner or type of locking mechanism may be utilized in this regard and that the advantages and purposes of the present invention are not realized only with particular types of locking mechanisms.

Applicants have determined that a critical structural point in the heddle frame assembly is at the four corners wherein slats 12 are connected to end braces 14. With ever increasing speeds of shedding operations, this critical location has proven to be a limiting factor in the life of the heddle frame. The vertical motion imparted to end braces 14 is transferred to slats 12 at the four corners of the frame. Thus, the relatively thin side walls of the extruded slats 12 continuously absorb the operational forces and vibrations associated with the shedding operations. As mentioned, the extruded aluminum slats are preferred in that they are extremely lightweight yet offer a relatively high degree of strength. However, applicants have determined that the thin side walls at the critical connecting points to the end braces are a limiting factor in the life of the heddle frame.

Figure 4:
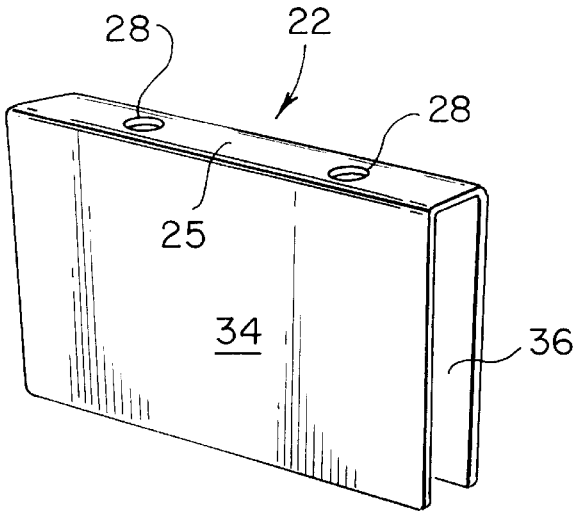
FIG. 4 is an alternative view of the corner sleeve member.
Figure 5:
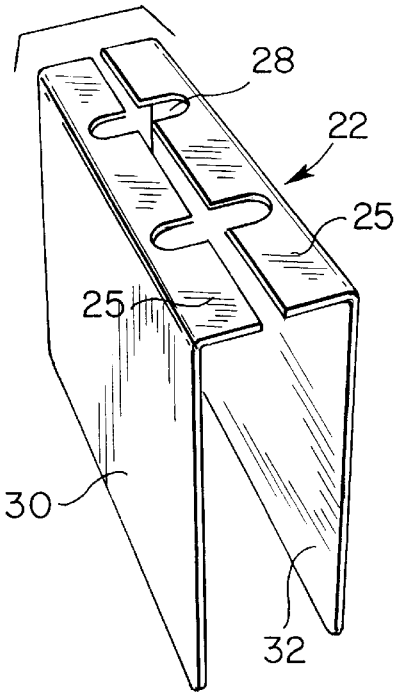
FIG. 5 is a view of one embodiment of the two-piece corner sleeve member according to the invention.

A corner sleeve member 22 is attached onto slats 12 directly adjacent to end braces 14 in order to structurally reinforce slats 12 at the connecting points without substantially adding to the weight or complexity of the heddle frames. Preferably, corner sleeve member 22 is a generally U-shaped element that fits over the outward edge 24 of slats 12. The sleeve 22 is preferably adhered to the slat, but other attaching devices may also be used. For example, the sleeve may be removably attached as well. The sleeve could also be welded onto the slat. Corner sleeve member 22 has a flat top section 25 which compliments outward edge 24 of slat 12. Sleeve member 22 has vertically extending side segments 34, 36 which extend alongside the long flat sections of slat 12. Side segments 34, 36 can be of equal length, as generally shown in FIGS. 2, 4 and 5. As is commonly understood, slats 12 typically contain a heddle rod 38 defined along the length thereof for receipt of the heddles along the length of slat 12. Side segments 34, 36 preferably extend at least to heddle rod 38.

Figure 3:
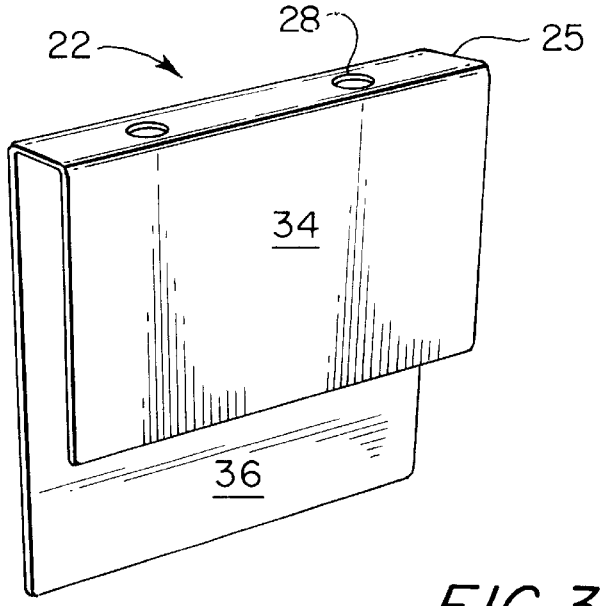
FIG. 3 is a perspective view of one embodiment of the corner sleeve reinforcing member according to the invention.

In an alternative embodiment, the length of side segments 34, 36 are different, as illustrated in FIGS. 1 and 3. For increased rigidity and stability, it may be preferred to extend one of the side segments beyond the heddle rod 38 on the opposite side of slat 12.

Sleeve members 22 can be attached to slats 12 in any conventional manner, including adhesives, welding, or mechanical attaching devices. In the embodiments illustrated, locking mechanisms 20 include at least one bolt 26 which extends through outward edge 24 of slat 12. Bolts 26 engage in a device which is housed within opening 16 of slat 12. An example of this type of conventional device is illustrated and described with particularity in U.S. Pat. No. 5,477,889. Bolts 26 can also be used to removably hold sleeve member 22 relative to slat 12 and extend through corresponding holes 28 defined in top section 25. It should be understood, however, that other devices are suitable for mounting sleeve 22 onto slat 12.

An alternative embodiment of sleeve 22 is illustrated in FIG. 5. In this embodiment, sleeve 22 comprises first and second pieces 30, 32. Pieces 30, 32 can overlap or butt together on the outward edge 24 of slat 12 and be held relative to slat 12 by bolts 26 and the adhesive, as particularly illustrated in FIG. 2. With this embodiment, sleeve 22 can be attached without having to completely disassemble the frame. Bolts 26 need only be loosened to an extent necessary to slide pieces 30, 32 onto slat 12.

It should be appreciated that sleeve member 22 can be easily retrofitted onto existing heddle frames and can be modified in any desired way to be accommodated with any conventional frame and locking mechanism.

It should be appreciated by those skilled in the art that various modifications and variations can be made in the present invention without departing from the scope and spirit of the invention. For example, the invention is not limited to any particular type of heddle frame or locking mechanism for locking the slats to the end braces. It is intended that the present invention cover such modifications and variations as come within the scope and spirit of the appended claims and their equivalents.

What is claimed is:

1. A heddle frame, comprising:

a pair of laterally extending slats and a pair of end braces connected to ends of said slats to form a generally rectangular frame;

an elongated opening defined at least in ends of said slats;

a locking mechanism at each corner of said frame operably configured with said end braces and said slats and disposed at least partially within said elongated openings to mechanically lock said slats to said end braces; and a corner sleeve member fitted over an outward edge of said slats at said ends thereof directly adjacent said end braces to structurally reinforce said slats at the position of said locking mechanism.

2. The heddle frame as in claim 1, wherein said locking mechanism comprises at least one bolt member disposed through an outward edge of said slat, said corner sleeve member comprising at least one hole therethrough to accommodate said bolt.

3. The heddle frame as in claim 1, wherein said corner sleeve member comprises two pieces mountable on said slats and joined at said outward edge of said slats.

4. The heddle frame as in claim 3, wherein said locking mechanism comprises a bolt member disposed through said outward edge of said slats, said two pieces overlapping on said outward edge and comprising holes therethrough to accommodate said bolt.

5. The heddle frame as in claim 1, wherein said corner sleeve member comprises side segments extending alongside flat sides of said slats.

6. The heddle frame as in claim 5, wherein said slats comprise a heddle rod along one of said sides, said side segments extending an equal distance towards said heddle rod.

7. The heddle frame as in claim 6, wherein said slats comprise a heddle rod along one of said sides, said side segments extending an unequal distance towards said heddle rod wherein said side segment opposite said heddle rod is longer than said other side segment.

8. A heddle frame, comprising:

a pair of laterally extending slats and a pair of end braces connected to ends of said slats to form a generally rectangular frame;

an elongated opening defined at least in ends of said slats;

a locking mechanism operably configured with said end braces and said slats and disposed at least partially within said elongated openings to mechanically lock said slats to end braces, said locking mechanism comprising at least one bolt member disposed through an outward edge of said slat; and a U-shaped corner sleeve fitted on an outward edge of said slats at said ends thereof directly adjacent said end braces to structurally reinforce said slats at the position of said locking mechanism, said sleeve comprising at least one opening therethrough to accommodate said locking mechanism bolt.

9. The heddle frame as in claim 8, wherein said corner sleeve comprises a single integral component.

10. The heddle frame as in claim 8, wherein said corner sleeve comprises two pieces joined at said outward edge of said slats.

11. The heddle frame as in claim 8, wherein said corner sleeve comprises side segments extending alongside flat sides of said slats.

12. The heddle frame as in claim 11, wherein said side segments are of unequal length.

13. A heddle frame, comprising:

a pair of laterally extending slats and a pair of end braces connected to ends of said slats to forma generally rectangular frame;

a locking mechanism operably configured with said end braces and said slats and disposed to mechanically lock said slats to said end braces at each corner of said frame; and a corner sleeve member attached to an outward edge and sides of said slats directly adjacent said end braces to structurally reinforce said slats at the position of said locking mechanism, said sleeve member comprising vertically extending side segments extending alongside opposite outward sides of said slats.

14. The heddle frame as in claim 13, wherein said sleeve member comprises a generally U-shaped member conforming to the shape of said slats.

15. A heddle frame, comprising:

a pair of laterally extending slats and a pair of end braces connected to ends of said slats to form a generally rectangular frame;

an elongated opening defined at least in ends of said slats;

a locking mechanism at each corner of said frame operably configured with said end braces and said slats and disposed at least partially within said elongated openings to mechanically lock said slats to said end braces; and a corner sleeve member attached to said slats at said ends thereof directly adjacent said end braces to structurally reinforce said slats at the position of said locking mechanism, said corner sleeve member comprising an essentially U-shaped member that fits over an outward edge of said slats.

16. The heddle frame as in claim 15, wherein said locking mechanism comprises at least one bolt member disposed through an outward edge of said slat, said U-shaped member comprising at least one hole therethrough to accommodate said bolt.

17. The heddle frame as in claim 15, wherein said U-shaped member comprises two pieces mountable on said slats and joined at said outward edge of said slats.

18. The heddle frame as in claim 17, wherein said locking mechanism comprises a bolt member disposed through said outward edge of said slats, said two pieces overlapping on said outward edge and comprising holes therethrough to accommodate said bolt.

19. A heddle frame, comprising:

a pair of laterally extending slats and a pair of end braces connected to ends of said slats to form a generally rectangular frame;

an elongated opening defined at least in ends of said slats;

a locking mechanism at each corner of said frame operably configured with said end braces and said slats and disposed at least partially within said elongated openings to mechanically lock said slats to said end braces; and a corner sleeve member attached to said slats at said ends thereof directly adjacent said end braces to structurally reinforce said slats at the position of said locking mechanism, said corner sleeve member comprising side segments extending alongside flat sides of said slats; and wherein said slats comprise a heddle rod along one of said sides, said side segments extending an unequal distance towards said heddle rod wherein said side segment opposite said heddle rod is longer than said other side segment.

20. A heddle frame, comprising:

a pair of laterally extending slats and a pair of end braces connected to ends of said slats to form a generally rectangular frame;

an elongated opening defined at least in ends of said slats;

a locking mechanism operably configured with said end braces and said slats and disposed at least partially within said elongated openings to mechanically lock said slats to end braces, said locking mechanism comprising at least one bolt member disposed through an outward edge of said slat; and a U-shaped corner sleeve fitted on said slats at said ends thereof directly adjacent said end braces to structurally reinforce said slats at the position of said locking mechanism, said sleeve comprising at least one opening therethrough to accommodate said locking mechanism, said corner sleeve member comprising two pieces joined at said outward edge of said slats.

* * * * *